US005268668A

United States Patent [19]

Berube

[11] Patent Number: 5,268,668

[45] Date of Patent: Dec. 7, 1993

[54] SECURITY/FIRE ALARM SYSTEM WITH GROUP-ADDRESSING REMOTE SENSORS

[75] Inventor: James E. Berube, Farmington, N.Y.

[73] Assignee: Detection Systems, Inc., Fairport, N.Y.

[21] Appl. No.: 817,866

[22] Filed: Jan. 7, 1992

[51] Int. Cl.[5] ..... G08B 26/00

[52] U.S. Cl. ..... 340/505; 340/518; 340/825.07

[58] Field of Search ..... 340/505, 518, 825.07–825.13, 340/825.54, 825.52, 825.53

[56] References Cited

U.S. PATENT DOCUMENTS

| | | | |
|---|---|---|---|
| 4,071,908 | 1/1978 | Brophy et al. | 340/825.02 |
| 4,361,832 | 11/1982 | Cole | 340/518 |
| 4,538,138 | 8/1985 | Harvey et al. | 340/505 |
| 4,658,243 | 4/1987 | Kimura et al. | 340/505 |
| 4,667,193 | 5/1987 | Cotie et al. | 340/825.54 |
| 4,996,518 | 2/1991 | Takahashi et al. | 340/518 |

*Primary Examiner*—Donnie L. Crosland

*Attorney, Agent, or Firm*—Warren W. Kurz

[57] ABSTRACT

A security/fire alarm system includes a plurality of event-sensors, e.g. intrusion and smoke sensors, each being identifiable by a unique digital address defined by a multibit binary address code. A central control unit operates to repeatedly address the sensors to determine their respective alarm and/or operating status. To minimize the cycle time required to sequentially interrogate all sensors, the central control unit operates to address groups of sensors simultaneously, each of the groups consisting of a sub-plurality of all the sensors. In response to being addressed, each sensor in an addressed group of sensors transmits a different binary bit or digit of a multibit digital response code which is defined collectively by the transmitted bits. The logical state of each of such binary bits indicates the general status (i.e. normal/abnormal) of the event-sensing unit that transmitted the bit. The control unit is responsive to the multibit response code to sequentially re-address only those event-sensing units that, through their respective binary bit, have indicated an abnormal status.

7 Claims, 4 Drawing Sheets

SECURITY/FIRE ALARM SYSTEM WITH GROUP-ADDRESSING REMOTE SENSORS

BACKGROUND OF THE INVENTION

The present invention relates to the field of security and fire protection. More particularly, it relates to improvements in security/fire alarm systems in which a relatively large number of remote sensors are actively monitored by a central control unit to ascertain their respective alarm and/or operating status.

Sophisticated security and fire alarm systems typically include a large number of various types of remote "event-sensors" for detecting, in a variety of ways, unauthorized entry, robbery attempts, fire, etc. To verify that each of the sensors is, indeed, operational and is, or is not, reporting an alarm condition, it is common in the art to provide a multiplex communication system by which a central control unit interrogates the sensors. In such a system, each of the sensors is assigned a unique address code and is linked to the control unit via a communications bus. The control unit interrogates each sensor by transmitting its respective address code on the bus and monitoring the bus for a response transmission by the addressed sensor. While such transmission and response typically takes on the order of milliseconds (e.g., 20–30 msec.) to complete for each sensor, it will be appreciated that a cycle time of the order of seconds can be required to complete the interrogation of 100 sensors. In many applications, such a cycle time is more than adequate for reporting a sensor failure or an alarm condition. But there are applications in which only a few seconds delay can spell the difference between success and failure of the system. Consider, for example, a situation in which a "hold-up" button is pressed and, due to the number of sensors on the bus, several seconds are required to activate a CCTV (closed-circuit TV). During such interval, the would-be robber may, for example, turn away from the camera and thereby conceal his identity.

SUMMARY OF THE INVENTION

In view of the foregoing discussion, an object of this invention is to reduce the cycle time required to repeatedly interrogate the remote sensors in a multisensor security/fire alarm system of the above type.

According to the invention, a security/fire alarm system includes a plurality of remote event-sensing units, e.g. intrusion and smoke sensing units, each being identifiable and addressable by a different multibit binary address code. Such system further comprises a central control unit which operates to repeatedly address the remote units to determine their respective alarm and/or operating status. To minimize the cycle time required to sequentially interrogate all remote units, the central control unit operates to address groups of remote units simultaneously, each of the groups consisting of a sub-plurality of all the remote units. In response to being addressed, each remote unit in an addressed group transmits a different binary bit or digit of a multibit digital response code which is defined collectively by the respective transmitted bits. The logical state of each of such binary bits indicates the general status (i.e. normal/off-normal) of the event-sensing unit that transmitted the bit. The control unit is responsive to the multibit response code to sequentially re-address only those remote units that, through their respective transmitted binary bit, have indicated an off-normal status.

The invention and its various advantages will be better understood from the ensuing detailed description of a preferred embodiment, reference being made to the accompanying drawings.

DETAILED DESCRIPTION OF PREFERRED EMBODIMENTS

In the description that follows, it should be understood that the invention has utility in any multisensor system in which the individual sensors communicate with a central control unit by means of a communications bus. Such systems include fire-detection systems, security systems, and any combination of these systems.

Figure 1:
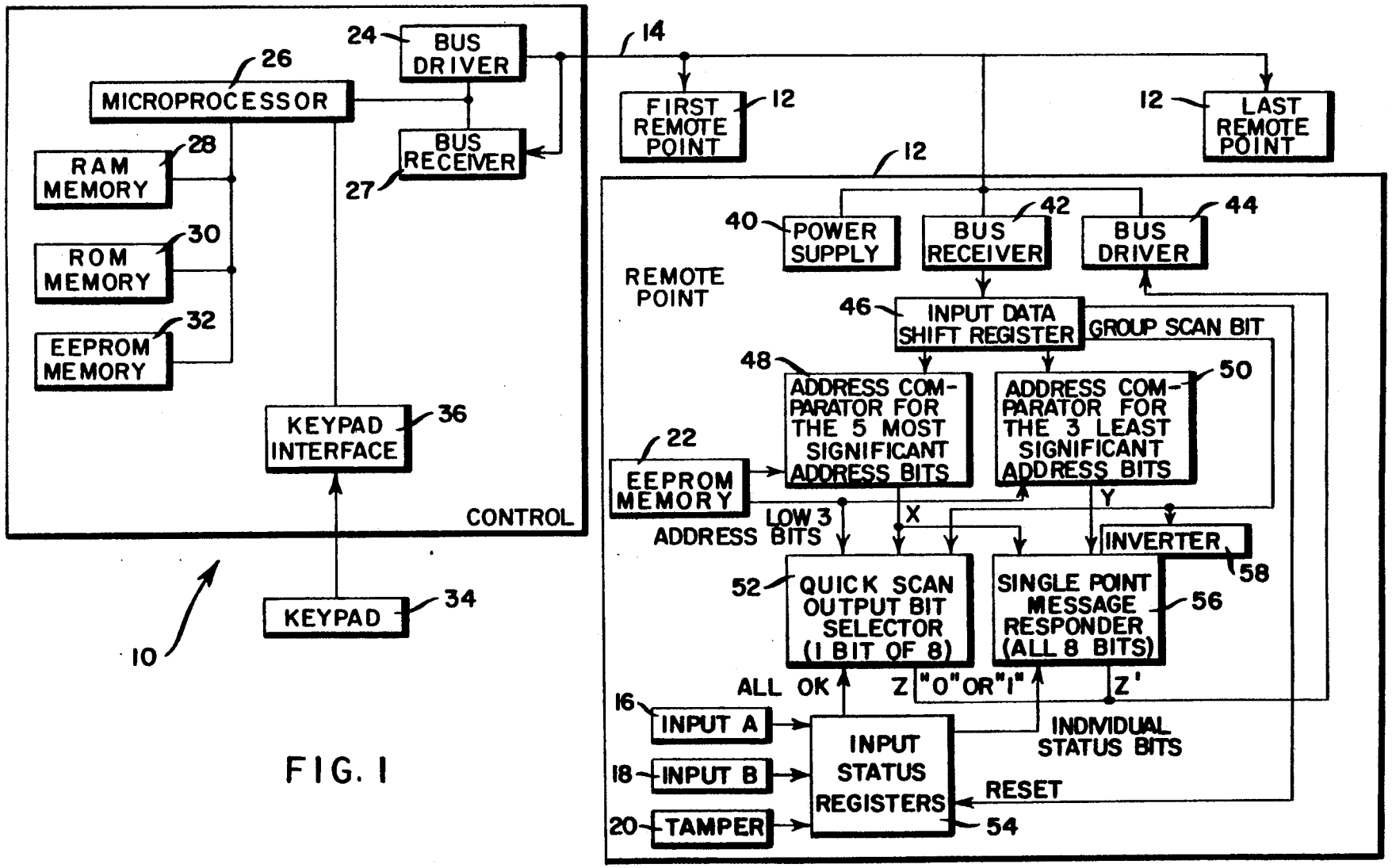
FIG. 1 is a block diagram schematically illustrating a security/fire alarm system embodying the present invention.

Referring to FIG. 1, a security system is shown to comprise a central control unit 10 which communicates with a plurality of remote event-sensing units 12 (e.g. intrusion sensors) via a communications bus 14. The number of remote units depends, of course, on the specific application, and may, for example, be as many as 256. Each of the remote units may include, for example, a pair of supervised inputs 16, 18 (e.g. from a microwave motion-detection device and a door switch) and a tamper-monitoring input 20. Each of the remote units is assigned its own binary address code which is stored in an EEPROM 22 and, in the case of a system with 256 remote points, such a code is defined by 8 bits.

The control unit comprises a bus driver 24 which operates under the control of a conventional microprocessor 26 to repeatedly interrogate the individual remote units on the bus. The control unit includes a bus receiver 27 for receiving communications from the remote units, a RAM memory 28 which serves to remember the status of each of the remote units upon being interrogated by the control unit, a ROM memory 30 which stores the program for interrogating the remote units (as explained below), and an EEPROM memory 32 which is a non-volitile memory which stores the detection and response characteristics of each remote unit, such as whether it comprises a smoke detector, an active or passive intrusion detector, a floor mat switch, etc. The end user (i.e. the customer) interacts with the control unit via a keypad 34 which, for example turns the system "on" and "off" through a keypad interface 36.

Control unit 10 interrogates the status of the remote units by transmitting a 13 bit communication on the bus, such communication being received by all remote units simultaneously. This communication contains 8 bits of address information, and 5 bits of control information. Note, in conventional multisensor alarm systems, the control unit typically addresses only one of the remote units at a time. Upon being addressed, each remote unit takes its turn in transmitting a multibit code representing its alarm status. Thus, to determine whether any of the remote units in a 256 remote unit system is "in alarm", 256 separate communications have to be made. At 30 milliseconds each, which is based on a typical clock speed, the total time required to interrogate 256 remote units requires nearly 8 seconds. For some applications, as indicated above, such a lengthy time period can be problematic.

Now in accordance with the present invention, the interrogation cycle time alluded to above is substantially reduced by a multiplex communication scheme in which "groups" of remote units are programmed to respond to the same interrogation signal substantially simultaneously. In the preferred embodiment, groups of eight remote units are simultaneously addressed to see if any one (or more) of the eight is in an "off-normal" condition that requires a control response. If the response of the first group indicates that all of the addressed units are "normal", then the control unit goes on to address another group, and so on, until all remote units are addressed. Assuming all remote units are "normal", it will be appreciated that the cycle time is decreased by factor equal to the number of remote units in a group (i.e., by a factor of 8 in this example). In responding as a group to a group address signal, the group response indicates not only the general operating status of the addressed units, but also specifically identifies which, if any, of the addressed units is "off-normal" and thus may require a further interrogation from the control unit to determine the specific nature of the problem. How this identification is made from the group response is explained below.

As shown in FIG. 1, each remote unit or "point" 12 comprises a power supply 40, a bus receiver 42 and a bus driver 44. As explained in more detail below, the bus receiver 42 of every point on the bus receives a multibit (e.g., 13 bits) interrogation signal from the control unit, and transmits that signal to a shift register 46. In response to being interrogated or addressed, the addressed point, via its respective bus driver 44, transmits either a one-bit or an eight-bit response code to the control unit, the number of bits depending on whether that particular remote point is being interrogated as a member of a group, or alternatively as a specific point, respectively.

According to a preferred embodiment, the control unit addresses the remote units by transmitting a 13-bit digital code which, as indicated above, is received by the bus receiver 42 of all remote units on the bus. Of the 13 bits transmitted, eight consecutive bits represent address information, and the remaining five represent control information. One of the control bits, the so-called "group-scan" bit, indicates whether this particular transmission is intended for a group of points, or for only one. The output of each bus receiver is stored in a shift register 46. The shift register feeds the most significant five bits of the eight bits of address information to a comparator 48 which compares these five bits with the five most significant bits of the unique address stored in the EEPROM 22 of that point. If there is no match between these five-bit groups of address information, then this particular point ignores the control unit's transmission. If, however, there is a match and the "group-scan" bit is present (i.e., a logical "1") to indicate that the present transmission is intended for a group of remotes, then this particular point is one of the remote units that is being addressed as a group. In the case of a five bit address match and the presence of a "group-scan" bit, the comparator produces an output X which enables a "quick-scan" output bit selector 52. In the event all of the inputs 16,18 and 20 are "OK" or normal, such status being reflected in an Input Status Register 54 (a latching circuit), the output bit selector 52 produces a one-bit output Z to the bus driver 44. This one-bit output, together with the respective one-bit outputs of the other points in the addressed group, defines an eight bit response code to the control unit. The time at which this one-bit response is produced relative to the respective one-bit responses of the other seven points in the addressed group is determined by the three least significant bits of address information stored in the EEPROM 22. As shown, a signal representing the three least significant address bits is fed to the output bit selector 52 which provides an output Z at a time, within a time period alotted for the respose code, based on the three least significant bits of address. Thus, for example, the remote point in the addressed group whose least significant 3 bits of address are 000 will provide the first bit of the 8 bit response code, the remote point whose least significant 3 bits of address are 001 will provide the second bit of this code, and so on to the remote with an address of 111, which will provide the eighth and final bit. As indicated above, the one-bit output Z of circuit 52 is fed to the bus driver which transmits this bit on the bus, back to the control unit. A logical "0" indicates a normal condition of all inputs. A logical "1" is interpreted as an "off-normal" condition, meaning that something is wrong with at least one of the three inputs.

To summarize, if the "group-scan" bit is present and the most significant 5 bits of the above-mentioned address code match the address programmed into the EEPROM of a remote point, than that remote will transmit one binary bit of information, a "0" to indicate a "normal" status, or a "1" to indicate an "off-normal" condition. The specific time at which this general status bit is transmitted by the remote unit is determined by the 3 least significant bits in the address code stored in the EEPROM 22. If all the bits are "zeros" in the group response code, the control unit goes on to address another group of remotes. If, however, there is a "1" in the group response code, the control unit will detect, from its position in the code, which remote(s) is "off-normal" and will re-address that particular remote unit(s) by its unique eight-bit address code to determine the specific nature of the problem and, hence, what service the control unit should supply, e.g., sounding an alarm, starting a CCTV, activating a "trouble" indicator, etc.

In re-addressing a particular remote unit, the "group-scan" bit is turned off (i.e. made a logical "0") via an inverting circuit 58, and a second comparator 50 cooperates with comparators 48 to provide outputs X and Y which enable a Single Point Message Responder 56. Comparator 50 compares the three least significant bits of the address communication with the three least significant bits of the address stored in EEPROM 22. The Single Point Message Responder 56 is operatively connected to the Input Status Register 54 to monitor the status of the inputs 16,18,20. Upon being enabled by the comparators, circuit 56 provides an eight-bit output Z' indicating the specific status of the three inputs. This signal is transmitted back to the control unit by the bus driver 44. (Add detail about inverter 58.)

In the above-described system, there is no parity or error checking in the "quick-scan" response since eight remote units are responding simultaneously. This is intentional to speed communications. But no "alarms" or "off-normal" conditions can be missed since, in each of the remote units, the specific event-sensor outputs are latched in the multiplex mode. Thus, if bus noise causes the control unit to see an "off-normal" remote unit as "normal", the "off-normal" condition will be detected on the next "quick-scan" communication. Since the system can operate eight times faster than the conventional system, even the extra scan will be four times faster than the conventional response time. If bus noise causes the control unit to see a "normal" remote as "off-normal", the control unit will communicate directly with that unit to verify that no service no service is required.

The following table illustrates the function of each bit of a 13 bit code transmitted by the control unit to the remote units on the communications bus:

TABLE 1

| Bit 1 | Bit 2 | Bits 3-8 | Bit 9 | Bit 10 | Bit 11 | Bit 12 | Bit 13 |
|---|---|---|---|---|---|---|---|
| Start Bit (zero) | Most significant address bit | Address bits | Least significant address bit | GROUP SCAN bit | SET OUTPUT bit | RESET bit in single point scan only | EVEN PARITY bit |
| | Bits 2-6 are group address | | Bits 7-9 are point address | 1=Group Scan 0=Point Scan | | 1=Reset input latches | |

In the above table, the "1" and "0" states are only exemplary. Bits 1-9 are self-explanatory. As indicated above, bit 10 indicates to the remote units whether or not this transmission is intended for a group or for an individual remote unit or "point". Bit 11 is used for programming verification. Bit 12 is used to reset the input latches in the remote unit during a point communication with an "off-normal" unit, and bit 13 is used for a parity check for a received communication.

The following table illustrates the function of each bit in an 8-bit group response code which is collectively produced on the communications bus by a group of remote units simultaneously addressed by the control unit:

TABLE 2

| Bit 14 | Bit 15 | Bit 16 | Bit 17 | Bit 18 | Bit 19 | Bit 20 | Bit 21 |
|---|---|---|---|---|---|---|---|
| Point 0 of group | Point 1 of group | Point 2 of group | Point 3 of group | Point 4 of group | Point 5 of group | Point 6 of group | Point 7 of group |
| 1=Loop A open, Loop A short, Loop B open, Loop B short or Tamper latch set 0=normal (Loop A supervised, Loop B supervised and no Tamper) | | | | | | | |

As indicated above, each remote unit (point) in a group transmits, in accordance with its address, a single bit of this 8-bit response code, the location of the bit being determined by the least 3 significant bits of the address stored in the EEPROM. The logical states indicated are, of course, only exemplary. The "Loops" referred to are two different event-sensors which are supervised, and the "Tamper" latch refers to a sensor designed to detect a sabotaging of the event-sensors.

The following table illustrates the function of each bit of an 8-bit point response code produced by a single remote unit in response to being invidually addressed by the control unit:

TABLE 3

| Bit 14 | Bit 15 | Bit 16 | Bit 17 | Bit 18 | Bit 19 | Bit 20 | Bit 21 |
|---|---|---|---|---|---|---|---|
| Flag Bit | Loop A Open | Loop A Short | Loop B Open | Loop B Short | Tamper | Odd Parity | Stop (zero) If B11=1 then return output state |

In the above table, bit 14 reflects the state of a programmed flag bit in the remote unit's EEPROM. Bits 15-19 indicate the status of the event-sensors in the remote units. The remaining two bits are used for a parity check, and as a stop bit, respectively.

Figure 3:
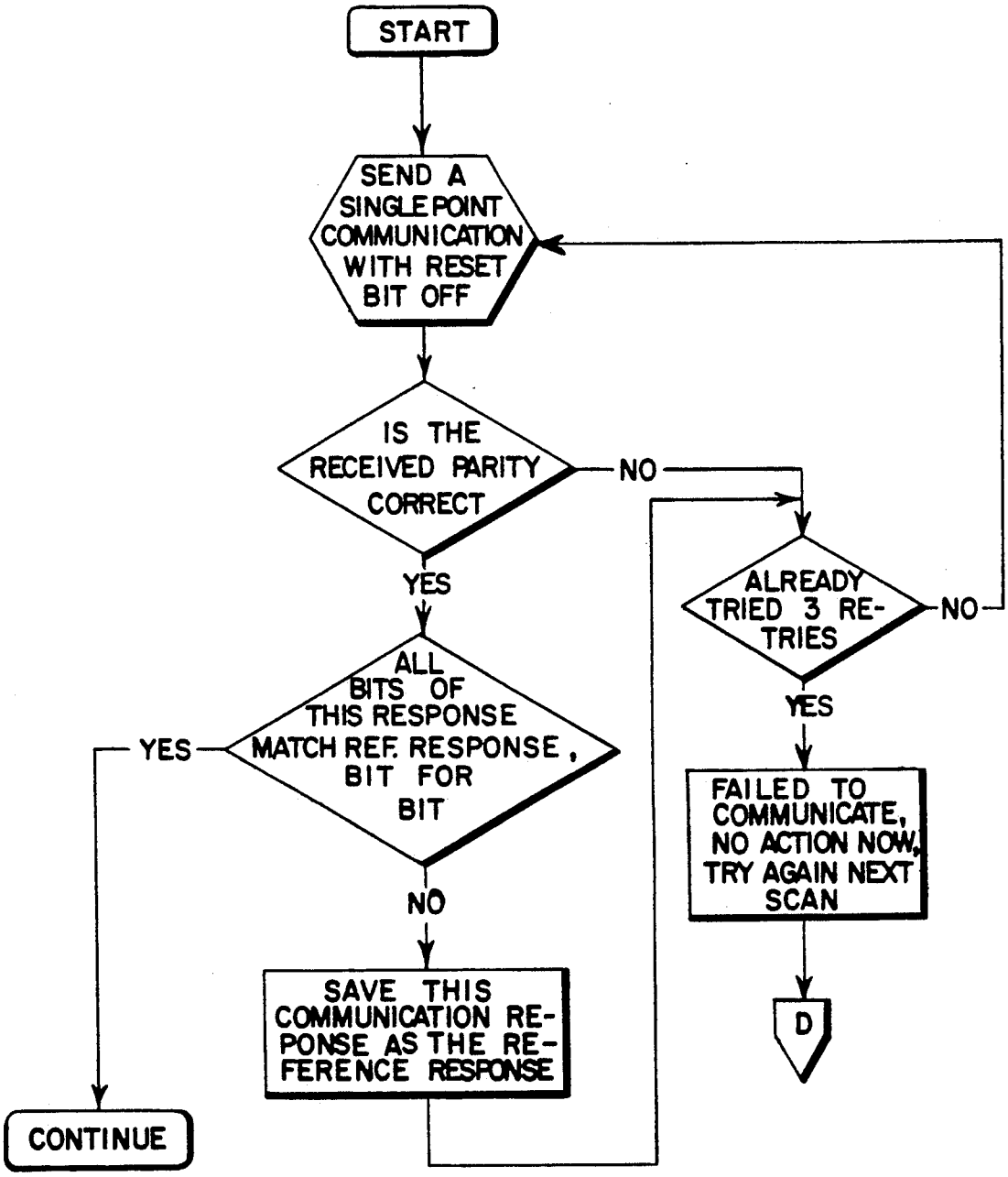
Figure 4:
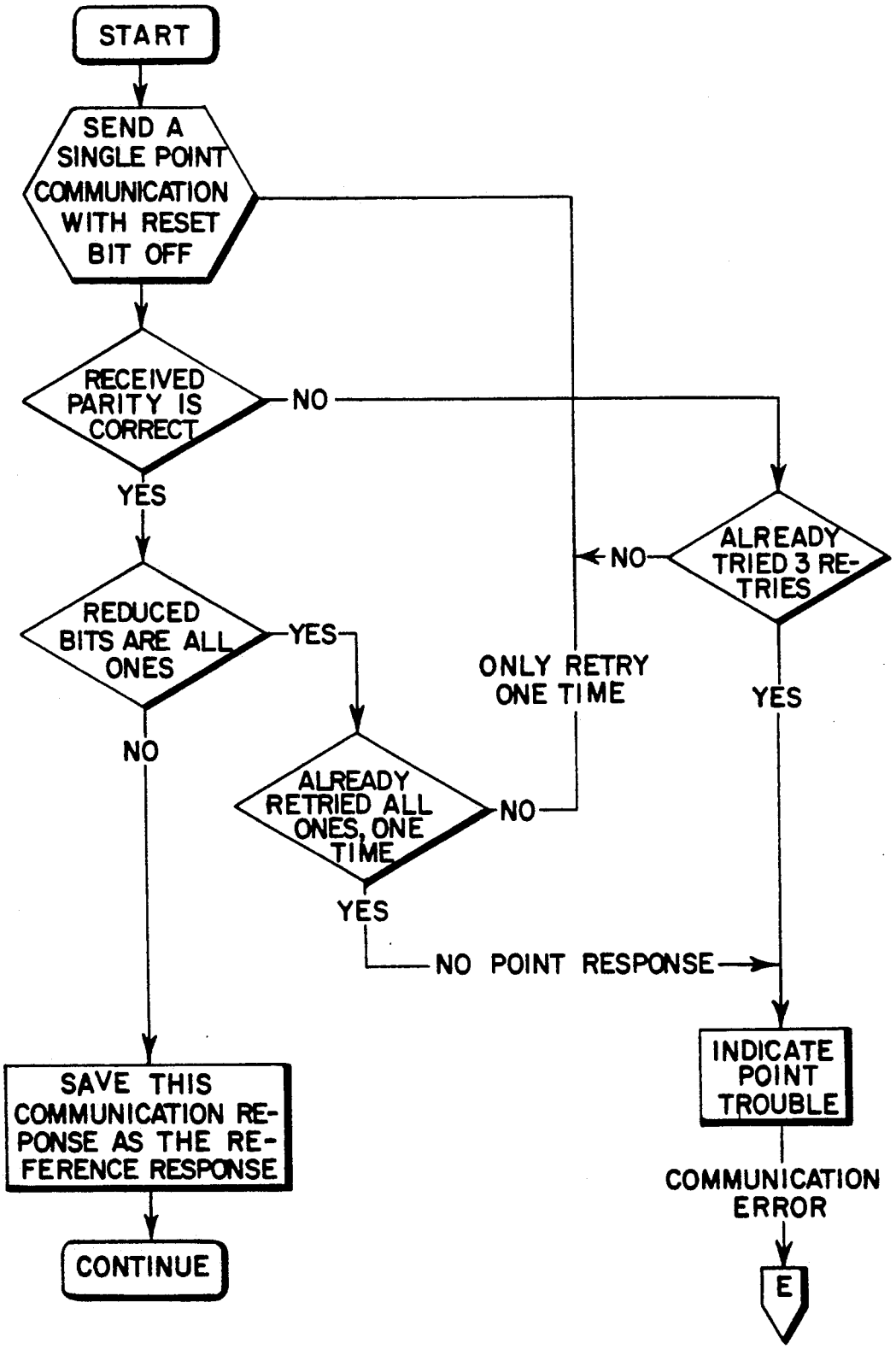

Referring now to FIGS. 3-5, the steps carried out by the control unit's microprocessor are shown in their logical sequence. Before starting the addressing process, the control unit determines if any of the points in the group which are about to be addressed are programmed to respond to the transmission. If none of the points in the group is turned "on" and programmed to respond, the controller advances to the next group. If any of the points in the to-be addressed group are programmed to respond, the control unit transmits its 13-bit quick-scan communication on the bus. In response to this communication, a multibit response code is produced collectively by the addressed group of remote units, i.e., those remote units whose 5 most significant address bits match those of the transmitted signal. The control unit then starts checking the response code, starting with the first point in the addressed group to see if readdressing of any point is required. First, it determines if the first point in the addressed group is active. If not, it ignores the response bit for that point and advances to the next point. If the response code indicates that the first remote unit is both active and "normal", the control determines whether this same remote unit indicated an "off-normal" response during the previous scan. If not, the controller considers the response of the second point in the addresses group, and so on until all points in the group have been considered. The controller than addresses the next group, and so until all groups have been addressed.

If the control determines that a points is "normal during the present scan, but indicated an "off-normal" condition during the previous scan, then the control unit sends a single point communication to the 8-bit address of such point to confirm the "normal" status indicated in the present response. In doing so, as shown in FIG. 3 which expands upon this branch of the logic, the reset bit (bit 12) is turned off (i.e. set to 0). The controller then checks the partly bit (bit 13) to see if the parity is correct. If so, and all bits of the multibit response (shown in Table 3) from the readdressed point match bit-for-bit to its previous response, the status of the point is updated in the control unit's memory. If parity checks out, yet the latest response does not correspond to the previous response, the latest response is saved as a reference response. The point is then readdressed again and the same process is repeated. If, after three tries, there is no bit-for-bit correspondence between to successive scans, the control unit takes no immediate action, and will try to communicate again on the next quick-scan communication.

Figure 2:
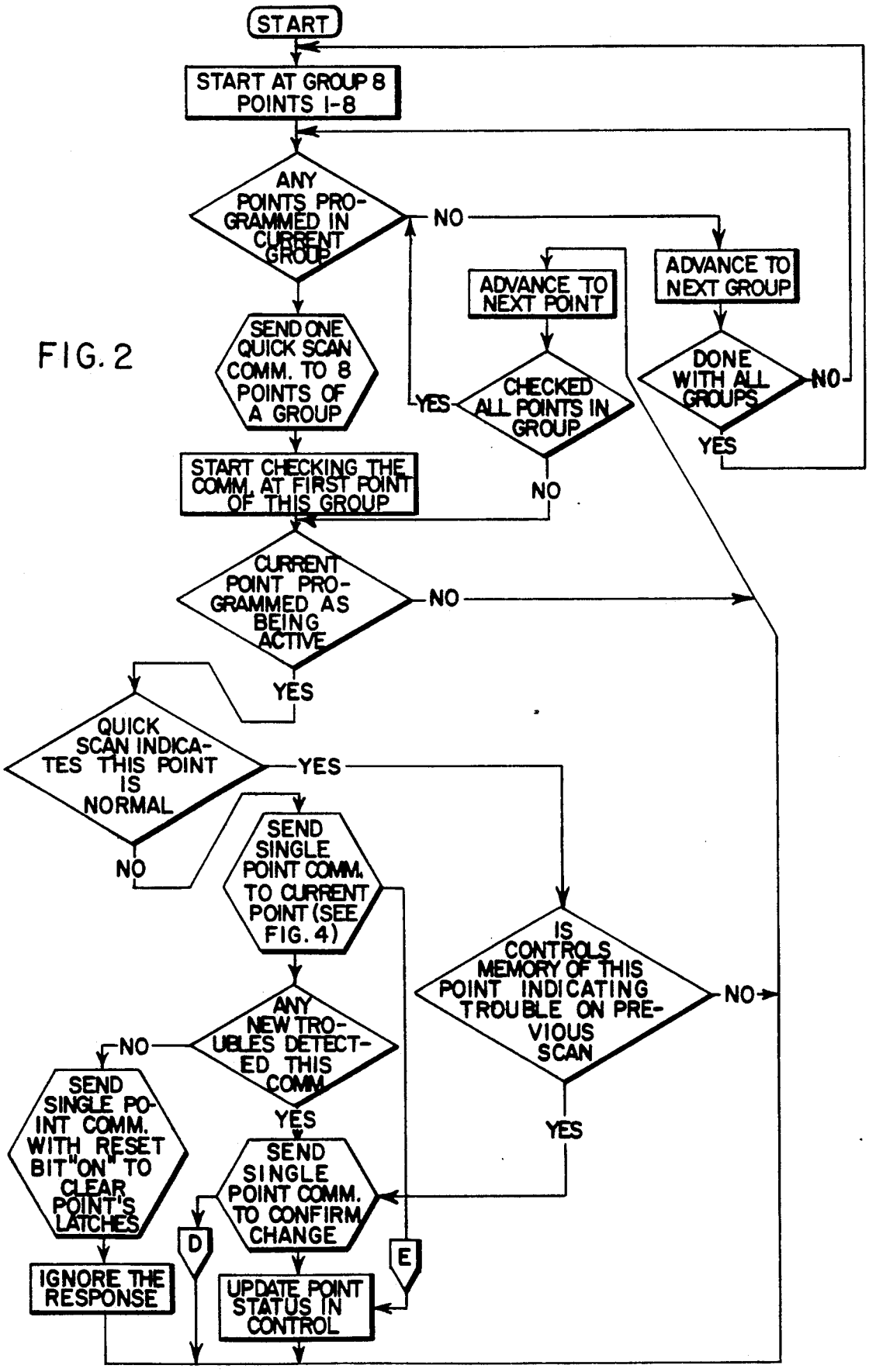
FIGS. 2–4 are flow charts illustrating the logical sequence of steps carried out by the microprocessor embodied in the control unit of the FIG. 1 system.

Referring again to FIG. 2, if the quick scan communication indicates that the status of the presently considered point is "off-normal", then the control unit immediately addresses such point. Referring to FIG. 4, such point addressing is done with the reset bit "off" (i.e. set for 0), If the parity is correct, and the response code is not all "ones", (which would indicate that no remote point responded to the group scan), this response code is saved in memory. Referring back to FIG. 2, the control unit then compares this saved response with the point's previously saved response to determine if any new "off-normal" conditions were reported during this response communication. If so, the process shown in FIG. 3 is repeated to verify the new response. If no new violations or troubles were detected during this response, the control unit readdresses the point to reset the latches of this point. The point's response to this latch-resetting communication is ignored. The control unit then goes on to consider the response of the next point in the group.

If the parity of the addressed point is still not correct after three tries, the control unit indicates a communication problem with the addressed point. If parity checks out and the point's response code is all "ones" (i.e. no point responded) after two tries, the control also indicates point trouble.

To summarize the operation of the communication system described above, the control unit uses the quick-scan (i.e. group scan) communication to detect any points that are "off-normal". The control sends quick-scan communications only to groups that are known to have points programmed in them. Each transmission takes approximately 30 milliseconds. If the group response for all programmed points in the first group is verified to be zero, the next group is scanned. If one (or more) of the programmed points does not return a zero as its response bit, the control unit sends a single point communication to find out the specific nature of the problem. If it is a new event, one that the control did not see in the previous scan, the single point communication is repeated to verify the data. If the event has been seen before, the point communication may contain a reset to see if the point will return to normal. The response to a transmission containing a reset will give the current (not latched) state of the event-sensors. The reset will remove the "off-normal" indication that does not remain off-normal. This sequence is repeated for all groups (and off-normal points) continuously. The worst case time to detect one point in a 256 system with only that point off-normal will take 33 transmissions of 30 ms. each, or a total of 990 ms. This compares favorably with a conventional point-by-point communication system which would require about 8 times as long, or about 8 seconds.

The invention has been described with particular reference to a preferred embodiment. Modifications can be made, of course, without departing from the spirit of the invention, and such modifications are intended to fall within the scope of the following claims.

What is claimed is:

1. A security/fire alarm system comprising (a) a plurality of addressable event-sensing units, each having a memory for storing a digital address code which is unique to each unit; and (b) a central control unit for repeatedly addressing sub-pluralities of said event-sensing units sequentially, and for simultaneously addressing all of the event-sensing units of an addressed sub-plurality of event-sensing units, each of the event-sensing units of an addressed sub-plurality of event-sensing units comprising means for transmitting a different portion of a multibit response code in response to being addressed by said central control unit, said event-sensing units responding in an order determined by their respective unique digital address code, said multibit response code being collectively defined by the respective response code portions transmitted by an addressed sub-plurality of event-sensing units, the logical state of each of said response code portions of said multibit response code, and the position of each of said response code portions within said multibit response code indicating the alarm/operating status and the particular event-sensing unit that transmitted the response code portion comprising said multibit response code.

2. The apparatus as defined by claim 1 wherein said central control unit is responsive to the multibit response code collectively defined by the individual binary bits transmitted by the event-sensing units of an addressed group to sequentially re-address only those event-sensing units that, through their respective binary bit, have indicated an alarm/operating status that differs from the alarm/operating status of the other event-sensing units of the addressed group.

3. The apparatus as defined by claim 2 wherein each of said event-sensing units comprises means for transmitting to said central control unit, in response to being re-addressed, a multibit status code representing the status of a plurality of parameters associated with a re-addressed event-sensing unit.

4. The apparatus as defined by claim 2 wherein said control unit addresses event-sensing units by transmitting a multibit interrogation signal on a bus connecting all event-sensing units with said central control unit, said multibit interrogation signal including a specific multibit address code identifying one event-sensing unit, and a signal indicating whether the interrogation signal is intended for such one event-sensing unit or a group of event-sensing units which share certain bits of said specific multibit address code.

5. The apparatus as defined by claim 4 wherein said event-sensing units comprise means for comparing the address code transmitted by said central control unit with the more significant bits of the stored address code of each event-sensing unit to determine whether to transmit a single bit response code to indicate the alarm/operating status thereof.

6. The apparatus as defined by claim 4 wherein each of said remote units further comprises means for transmitting said different bit of said multibit response code at a time determined by the least significant bits of the respective address codes stored by an addressed group of said event-sensing units.

7. A security/fire alarm system comprising (a) a plurality of addressable event-sensing units, each being identifiable by a unique multibit binary address code stored in a memory located in each of said event-sensing units, and (b) a central control unit for repeatedly addressing said plurality of event-sensing units to repeatedly determine the alarm/operating status of each event-sensing unit, said plurality of event-sensing units being divided into a plurality of different groups of event-sensing units, each of said different groups comprising a sub-plurality of event-sensing units having a common group address code;

said central control unit comprising means for addressing all of the event-sensing units of a group by their common address code simultaneously;

each of said event-sensing units of an addressed group of event-sensing units comprising means for transmitting a different portion of a multibit digital response code in response to being addressed by said central control unit, said event-sensing units responding in an order determined by their respective unique digital address code, the logical state and position of each of said response code portions within said response code indicating the alarm/operating status of and the particular event-sensing unit that transmitted each of said response code portions; and said central control unit being responsive to the multibit response code collectively defined by the individual response code portions transmitted by the event-sensing units of an addressed group to sequentially re-address only those event-sensing units that, through their respective response code portion, have indicated an alarm/operating status that differs from the alarm/operating status of the other event-sensing units of the addressed group.

* * * * *